US012121158B2

(12) United States Patent
Cruz-Mansilla et al.

(10) Patent No.: US 12,121,158 B2
(45) Date of Patent: Oct. 22, 2024

(54) BABY INCLINE SLEEPER

(71) Applicants: Ana Adriana Cruz-Mansilla, Houston, TX (US); Paul Robert Juhasz, Houston, TX (US)

(72) Inventors: Ana Adriana Cruz-Mansilla, Houston, TX (US); Paul Robert Juhasz, Houston, TX (US)

( * ) Notice: Subject to any disclaimer, the term of this patent is extended or adjusted under 35 U.S.C. 154(b) by 0 days.

(21) Appl. No.: 17/398,856

(22) Filed: Aug. 10, 2021

(65) Prior Publication Data

US 2022/0039562 A1 Feb. 10, 2022

Related U.S. Application Data

(60) Provisional application No. 63/063,745, filed on Aug. 10, 2020.

(51) Int. Cl.
*A47D 13/08* (2006.01)
*A47D 15/00* (2006.01)

(52) U.S. Cl.
CPC ..... *A47D 13/08* (2013.01); *A47D 15/008* (2013.01)

(58) Field of Classification Search
CPC ..... A47D 15/003; A47D 15/008
See application file for complete search history.

(56) References Cited

U.S. PATENT DOCUMENTS 4,733,836 A * 3/1988 Barnes ..... A47D 13/08 5/639
5,387,177 A * 2/1995 Dunn ..... A61G 7/07 5/655
6,381,787 B1 * 5/2002 Rogone ..... A47D 13/08 5/655
6,954,954 B2 * 10/2005 Stelnicki ..... A47D 15/003 5/655
8,118,268 B2 * 2/2012 Mabry ..... A61J 9/0638 5/655

(Continued)

FOREIGN PATENT DOCUMENTS

FR 2896969 A1 * 8/2007 ..... A47D 15/008

OTHER PUBLICATIONS https://www.youtube.com/watch?v=oF8MgjrEYhw Sy Nesting for newborns in the hospital setting, Sydney Children's Hospitals Network 2019 (Year: 2019).*

(Continued)

*Primary Examiner* — Adam C Ortiz
(74) *Attorney, Agent, or Firm* — The Juhasz Law Firm

(57) ABSTRACT

A sleeping device including an inclined mat or an inclination segment under a mat positionable under a baby for sleep. The inclined mat or the inclination segment includes a top surface area, a bottom surface area, and a thickness area lying therebetween. The bottom surface area is configured to lie against a sleeping surface and the top surface area is configured to lie against a baby. The top surface area of the inclined mat or the inclination segment includes an elevated surface, a downwardly surface, and a lower surface configured to receive a back of the head of the baby. The downwardly surface is configured to support a side of the head of the baby lying toward the downwardly surface to prevent the head from turning to a position wherein the side of the head lies planar with the sleeping surface.

22 Claims, 11 Drawing Sheets

(56) References Cited

U.S. PATENT DOCUMENTS

| | | | | |
|---|---|---|---|---|
| 8,671,484 | B1 * | 3/2014 | Logiodice | A47D 13/08 5/655.4 |
| 2004/0154099 | A1 * | 8/2004 | Waters | A47G 9/0253 5/655 |
| 2005/0283915 | A1 * | 12/2005 | Hahn | A47D 9/00 5/655 |
| 2006/0010605 | A1 * | 1/2006 | Kamrin-Balfour | A47C 7/72 5/904 |

OTHER PUBLICATIONS

CNET Internet News article, David Priest, Fisher-Price Newborn Rock 'n Play Sleeper with SmartConnect Review, https://www.cnet.com/reviews/fisher-price-deluxe-newborn-auto-rock-n-play-sleeper-with-smartconnect-review/ May 26, 2016, (20 pages).

Daily Mail (U.K.) Internet news article, Natalie Rahhal, Do Not use any inclined baby sleepers, Nov. 1, 2019 (46 pages) See esp. first 5 pages https://www.dailymail.co.uk/health/article-7640781/Do-NOT-used-inclined-sleepers-officials-warn-death-toll-hits-73-babies.html.

* cited by examiner

BABY INCLINE SLEEPER

CLAIM TO PRIORITY

This application claims priority to, and the benefit of, U.S. Prov. Appl. 63/063,745, filed Aug. 10, 2020, the disclosure of which is incorporated by reference in its entirety.

FIELD OF INVENTION

This disclosure is directed to baby and head support products and more particularly to baby sleeper products and inclined head resting products.

BACKGROUND

When putting a baby down at bedtime, it is known that sleeping the baby on the back is preferred. However, babies may move in their sleep and manage to roll onto their side. Alternatively, a baby may refuse to fall asleep until the baby is put on its side.

Sleeping a baby on its side may create worry including it being not the safe sleeping position for the baby including the increased risk of sudden infant death syndrome (SIDS).

SIDSs is the sudden and unexplained death of a young. The risk for SIDS is highest in the first 3 months, but it can happen at any time up until around the age of 1 year. Stomach sleeping increases the risk of sudden infant death syndrome (SIDS) and suffocation, and it's an easy roll from side to stomach—gravity means very little effort on baby's part.

SIDS prevention includes placing the baby on his or her back to sleep, for naps and at nights; the use of firm and flat sleep surfaces such as mattress in a safety-approved crib covered by a fitted sheet with no other bedding or soft items in the sleep area; and sleeping the baby near the parents.

Another worry is choking. Studies show back sleeping has a lower risk of choking. Babies are better able to clear their airways while sleeping on their backs. They have automatic reflexes that make them cough up or swallow any spit-up that happens, even while sleeping.

Another worry is flat head. Babies are born with softer skulls. They also have weak neck muscles in the early months of life. This means that sleeping in one position—back or a particular side—for too long may cause some flattening. This is totally normal and usually goes away by itself. There are also several ways to prevent flat spots from happening in the first place.

Another worry is torticollis risk. Torticollis is a problem involving the muscles of the neck that causes the head to tilt down. The term comes from two Latin words: tortus, which means twisted, and collum, which means neck. Sometimes it's called "wryneck." It can often be treated with neck-strengthening exercises. As for sleep though, torticollis can also affect how the baby sleeps. The baby may prefer sleeping on one side or turning their head to the same side every night to be more comfortable. But this is not ideal since it may create the problems explained herein and other problems.

Another worry is Harlequin color change. Harlequin color change is a cutaneous condition seen in newborn babies characterized by momentary red color changes of the baby, which may be sharply demarcated at the body's midline. A small percent of healthy newborns have harlequin color change when they sleep on their sides. This harmless condition may cause half of the baby's face and body to become pink or red. The color change is often temporary and goes away on its own after some time. It may recur when the infant is placed on his or her side.

While back sleeping may be best, side sleeping can also be safe as the baby grows and gets stronger.

While the foregoing addresses baby products, there are problems that exist for any person whose head must be kept from lying planar with the surface when the person is lying against a surface in an inclined position.

There continues to be a need for improved designs of sleeping devices and inclined head support devices. This disclosure addresses that need.

SUMMARY

A sleeping device comprising a mat positionable under a baby for sleep. The mat may be formed from a cushionable material that does not gather when the mat is positioned under the baby for sleep. The mat includes a top surface area, a bottom surface area, and a thickness area, the thickness area lying between the top surface area and the bottom surface area. The bottom surface area is configured to lie against a sleeping surface and the top surface area is configured to lie against a baby. The top surface area of the mat includes an elevated surface, a downwardly inclined surface extending from the elevated surface, and a lower surface extending from the downwardly inclined surface. The lower surface is configured to receive a back of the head of the baby when the baby is placed against the lower surface of the mat when the mat is positioned under the baby. The downwardly inclined surface is configured to support a side of the head of the baby lying against the downwardly inclined surface. The downwardly inclined surface is configured to prevent the head of the baby lying against the downwardly inclined surface from turning in the direction of the downwardly inclined surface to a position wherein the side of the head of the baby lies planar with the sleeping surface.

In alternative embodiments, the top surface area of the mat further includes an upwardly inclined surface extending from a side of the lower surface opposite the downwardly extending surface. The upwardly inclined surface is configured to support a side of the head of the baby lying against the upwardly inclined surface. The upwardly inclined surface is configured to prevent the head of the baby lying against the upwardly inclined surface from turning in the direction of the upwardly inclined surface to a position wherein the side of the head lies planar with the sleeping surface. The downwardly inclined surface and the upwardly inclined surface are configured to prevent the head of the baby from turning in the either the direction of the downwardly inclined surface or the direction of the upwardly inclined surface to a position wherein the side of the head lies planar with the sleeping surface.

While designed for babies, the device may be useable for any person whose head when the person is lying against a surface in an inclined position must be kept from lying planar with the surface.

DESCRIPTION OF DRAWINGS

FIGS. 1A, 1B, 1C collectively comprise FIG. 1.

FIGS. 2A, 2B collectively form FIG. 2.

FIGS. 3A, 3B, 3C collectively form FIG. 3C.

FIGS. 4A, 4B, 4C collectively comprise FIG. 4.

FIGS. 5A, 5B, 5C collectively form FIG. 5.

FIGS. 6A, 6B, 6C collectively form FIG. 6.

FIGS. 7A, 7B collectively form FIG. 7.

FIGS. 8A, 8B collectively form FIG. 8.

FIGS. 9A, 9B, 9C collectively form FIG. 9.

DETAILED DESCRIPTION

Figure 1A:
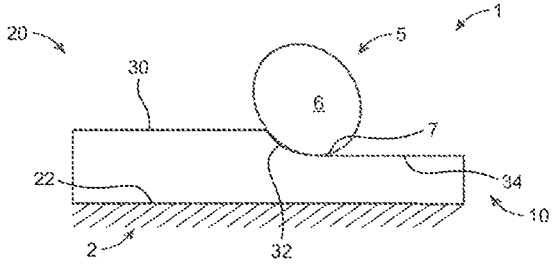
FIG. 1A depicts an illustrative sleeping device according to this disclosure in cross-section.

In the following detailed description, reference is made to the accompanying drawings that form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented herein. It will be readily understood that the aspects of the present disclosure, as generally described herein, and illustrated in the Figures, can be arranged, substituted, combined, separated, and designed in a wide variety of different configurations, all of which are explicitly contemplated herein.

Broadly speaking, disclosed herein is a sleeping device including an inclined mat or an inclination segment under a mat positionable under a baby for sleep. The inclined mat or the inclination segment includes a top surface area, a bottom surface area, and a thickness area lying therebetween. The bottom surface area is configured to lie against a sleeping surface and the top surface area is configured to lie against a baby. The top surface area of the inclined mat or the inclination segment includes an elevated surface, a downwardly surface, and a lower surface configured to receive a back of the head of the baby. The downwardly surface is configured to support a side of the head of the baby lying toward the downwardly surface to prevent the head from turning to a position wherein the side of the head lies planar with the sleeping surface.

The inclined mat or an inclination segment may preferably be formed from a foam but may be formed from a material such as a foam, polyester fiberfill, a mix of both. The foam may be a high-density memory foam, a firm foam, or foam of other firmness sufficient to perform the functions of this disclosure. The inclined mat or inclination segment may be provided with a removable covering. The removable covering may preferably be a cotton but the removable covering may be formed from cotton, polyester, nylon, linen, satin, or other material biofriendly to a baby.

In embodiments where an inclination segment is provided with a mat overlay as disclosed below, the mat may preferably be formed from a polyester material but may be formed from a cotton, polyester, nylon, linen, satin, or other material biofriendly to a baby.

The material of the removable covering or mat is one that should not ruffle or bunch, the material should be configured so as to not "gather" so as to avoid ruffles or bunches that may interfere with the breathing of the baby.

Figure 1B:
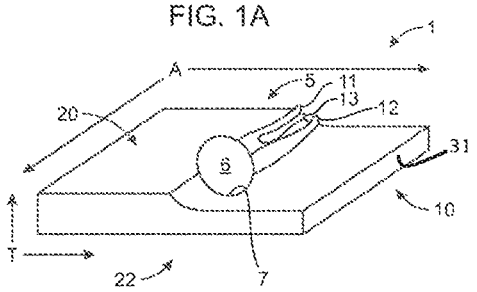
FIG. 1B depicts the sleeping device in perspective.

FIG. 1 depicts sleeping device 1 comprising an inclined mat 10 positionable under a baby 5 for sleep. The baby 5 is depicted with head 6, feet 11, 12, and hand 13 (only one hand is shown).

The inclined mat includes a top surface area 20 (with "A" depicting the area), a bottom surface area 22 (with "A" depicting the area), and a thickness area T (with "T" depicting the area), the thickness area lying between the top surface area 20 and the bottom surface area 22. The bottom surface area 22 is configured to lie against a sleeping surface 2 (which may be a bottom 92 of a crib 90) and the top surface area 20 is configured to lie against the baby 5. The top surface area 20 of the inclined mat includes an elevated surface 30, a downwardly inclined surface 32 extending from the elevated surface, and a lower surface 34 extending from the downwardly inclined surface 32. The downwardly inclined top surface 32 has a common endpoint 36 with the elevated top surface 30, the downwardly inclined top surface 32 has a common endpoint 35 with the lower top surface 34. The lower top surface 34 opposite the downwardly inclined surface 32 terminates at a terminal edge 31. The lower surface 34 is configured to receive a back 7 of the head 6 of the baby 5 when the baby is placed against the lower surface 34 of the inclined mat 10 when the mat is positioned under the baby. The downwardly inclined surface 32 is configured to support a side of the head of the baby lying against the downwardly inclined surface. The downwardly inclined surface is configured to prevent the head of the baby lying against the downwardly inclined surface 32 from turning in the direction of the downwardly inclined surface to a position wherein the side of the head of the baby lies planar with the sleeping surface 2.

Figure 1C:
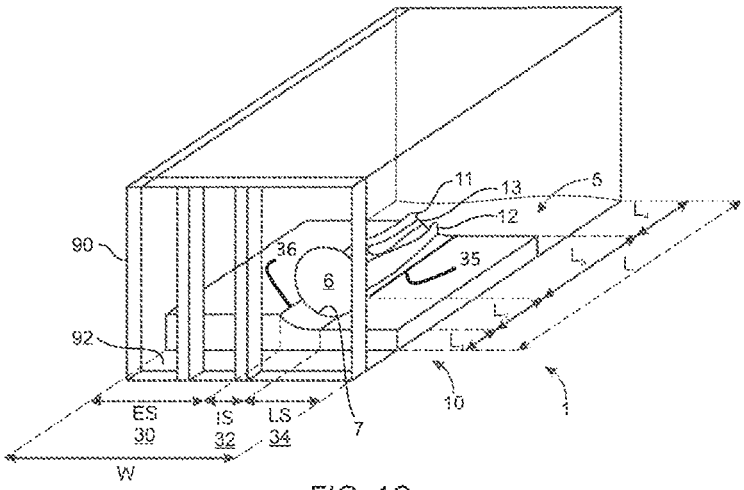
FIG. 1C depicts the sleeping device in a crib which provides a support surface.

As depicted in FIG. 1C, the width of elevated surface 30 (depicted as ES) may be of a width sufficient to allow the baby to lay comfortably in the lower surface 34 (depicted with a width of LS) and still allow the inclined surface 32 (depicted with a width of IS) to support the head of the baby in the event the head of the baby turns in that direction. In one embodiment, the width ES of elevated surface 30 extends about halfway across the width of crib 90. In alternative embodiments, the width ES of elevated surface 30 may extend across less than halfway or more than halfway across the width (depicted as W) of the crib 90. The width of lower surface 34 (depicted as LS) may be of width sufficient to allow the baby to lay comfortably and allow the inclined surface 32 (depicted as IS) to support the head of the baby in the event the head of the baby turns in that direction. When positioned in the crib 90 or a bassinet, the lower surface 34 extending away from the inclined surface 32 may terminate at or near the edge or wall of the crib 90 or bassinet. In that way the edge or wall of the crib or bassinet may provide a stop surface to both keep the baby inside the crib or bassinet and keep the baby in the lower surface 34. In one example, the body of the baby fits entirely within the width of the lower surface 34. In another embodiment, the body of the baby fits largely within the width of the lower surface 34 with the remaining body laying against the inclined surface. The inclined mat may be configured with any dimensional that accomplishes the advantages of the inclined mat taught by this disclosure.

The length of the inclined surface in the mat may be L2 for example if designed to break the fall of a roll of the head of a baby. The length may be L1 and L2 to provide a greater inclined surface for breaking the fall of the rolling head. The length may be L1, L2, L3 to also provide support against the roll of the body of the baby. The length of the inclined surface may be the length L of the inside of the crib. As another example, the length may be L3 configured to break the roll of the body of a baby. In this example, there may be no inclined surface against the head of the baby for example where the concern of the parent goes to rolling of the body at night and not so much the roll of the head. For example, the baby may be one having a neck strength sufficient to keep the head from rolling and it is the rolling of the body that is of concern to the parents. Any length of inclined surface that breaks and supports the head of the baby on a roll may be used.

The inclined surface may be a surface that angles away from the elevated surface 30 toward the lower surface 34. By inclined surface is meant an inclined surface as herein disclosed including the inclined surface angling downwardly from an elevated surface towards the lower surface 34 and the inclined surface angling upwardly from the lower surface to an elevated surface as explained later on in other examples herein contained. The inclined surface may be a flat surface, a surface with a curve, a combination of both, or of other configuration. A curve in the inclined surface may curve towards or away from the lower surface or curve towards and away from the lower surface along the inclined surface. The inclined surface may be of any dimensional configuration sufficient to stop the side of the head of the baby from lying planer the lower surface. The inclined surface may be of any dimensional geometry sufficient to stop the side of the head of the baby from lying against the lower surface. For example, the inclined surface may preferably have a degree of incline when taken with respect to the support surface of 30 degrees. Alternatively, the degree of incline may be 15 to 45 degrees. A degree of incline below 15 or above 45 may also be used depending upon the incline desired to stop the head from rolling onto its side.

Figure 2A:
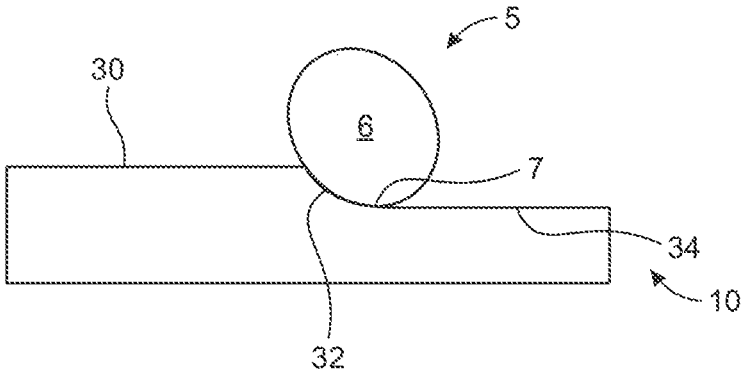
FIG. 2A is the same figure as FIG. 1A depicting inclined surface of inclined mat positioned along the other side of the head of the baby.
Figure 2B:
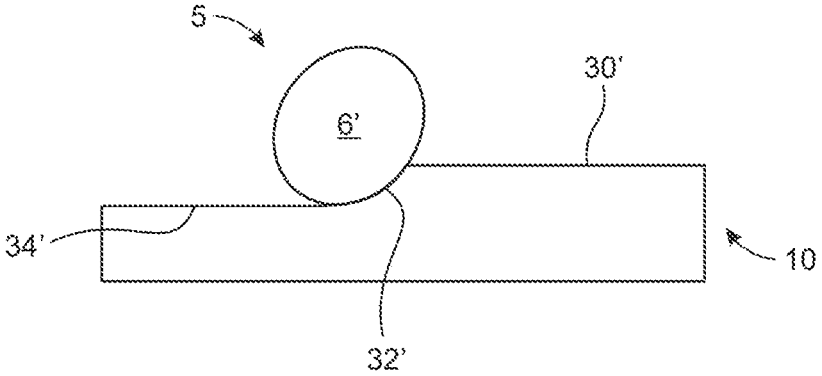
FIG. 2B depicts inclined surface of inclined mat positioned along the right side of the head of the baby.

FIG. 1A depicts inclined surface 32 positioned along the left side of the head of the baby. FIG. 2B depicts inclined surface 32' positioned along the right side of the head of the baby. FIG. 2A is the same figure as FIG. 1A but depicted alongside FIG. 2B to illustrate the identicality of the functional features of the inclined mat that may be configured to be mirror images of each other in order to stop the movement of the head of the baby in the left or right direction when the body of the baby is positioned as depicted in these FIGS. The inclined mat depicted in FIG. 2A positioned along one side of the head may be the same inclined mat depicted in FIG. 2B positioned along the other side of the head. Alternatively, two inclined mats may be used, a first inclined mat positioned along one side of the head and another positioned along the other side of the head.

If two inclined mats are used, the two inclined mats may be mirror images of each other. Alternatively, one inclined mat may have the inclined surface at a different degree of incline than the degree of incline of the other inclined mat. For example, The different configurations of the inclined mat give parents the option of selecting the inclined mat that best suits the sleeping preferences of the baby. For instance, the parents of a baby having a tendency to sleep on the left side of his or head may find positioning the inclined mat as depicted in FIG. 2A more advantageous since this allows the baby to face towards the inclined mat when the baby moves his or head in the left direction during sleep. Positioning the inclined mat as depicted in FIG. 2B may be more advantageous when the baby has a tendency to move his or head in the right direction during sleep. The inclined mat may also be positioned in the crib so that the baby faces the front or back of the crib. For example, FIG. 2A depicts the head 6 of the baby facing to the left. If the parent wants the baby to face the back of the crib, to the left would be the back of the crib. If the parent wants the baby to face the front of the crib in this example, the inclined mat depicted in FIG. 2A and the baby would be turned around so that the baby facing to the left would face the front of the crib.

Figure 3A:
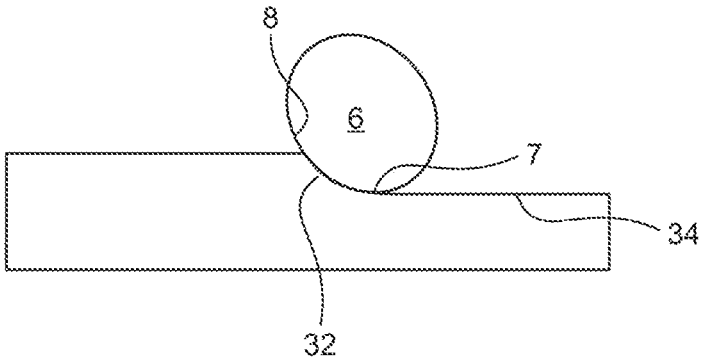
FIG. 3A depicts a sleeping device with a side of the head of a baby shown to be away from inclined surface.
Figure 3B:
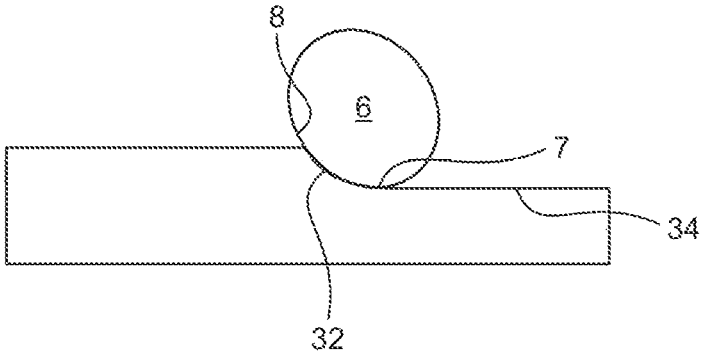
In FIG. 3B, side is shown to lie against inclined surface.
Figure 3C:
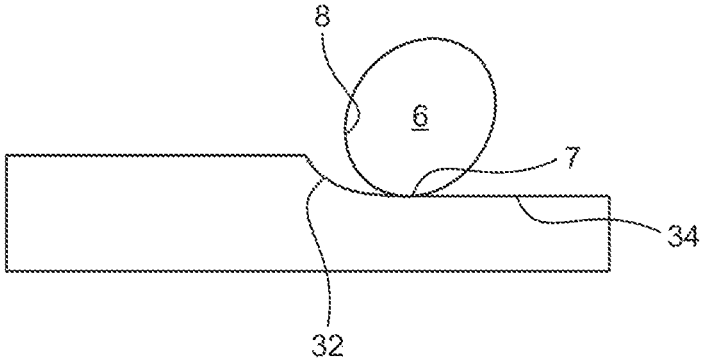
In FIG. 3C, side is shown to lie away from inclined surface.

FIG. 3 depicts sleeping device 1 of FIG. 1 with back 7 of head 6 of baby 5 against lower surface 34. In FIG. 3A, side 8 of the head 6 of baby 5 is shown to be away from inclined surface 32. In FIG. 3B, side 8 is shown to lie against inclined surface 32. In FIG. 3C, side 8 is shown to lie away from inclined surface. FIGS. 3A, 3B illustrate that when baby 5 turns head 6 toward inclined surface 32, the inclined surface keeps head 6 of baby from turning entirely to its side thereby alleviating some of the problems with baby sleepers previously noted.

Figure 4A:
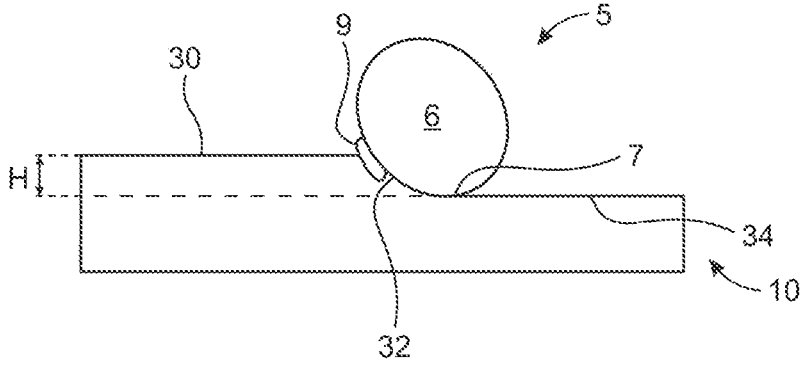
FIGS. 4A, 4B, 4C depicts three illustrative embodiments of the inclined mat of this disclosure with differing heights H.
Figure 4B:
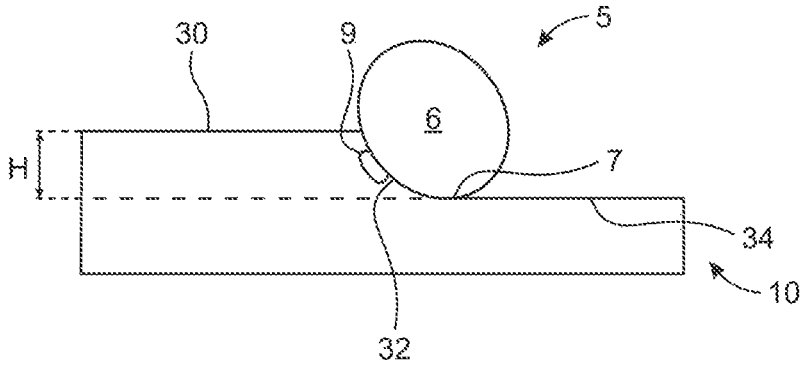
Figure 4C:
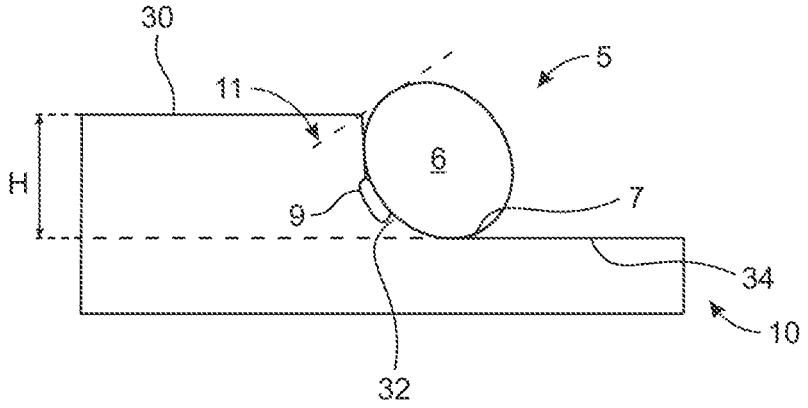

FIG. 4 depicts three illustrative embodiments of the inclined mat 10 of this disclosure with differing heights H. FIG. 4A depicts height H as dimensionally high enough that the part of the head at or below the ear 9 is supported by the inclined surface. FIG. 4B depicts height H as dimensionally high enough that the part of the head up through above the ear 9 is supported by the inclined surface. FIG. 4C depicts height H as dimensionally high enough that the inclined surface may lie against most of the head when the baby is leaning against the inclined surface. Other heights H that support the head of the baby in a way that stops the head of the baby lying against the downwardly inclined surface from turning in the direction of the downwardly inclined surface to a position wherein the side of the head of the baby lies planar with the sleeping surface is within this disclosure. The inclined mat keeps the full weight of the head of the baby off the side of the head as may occur when the head of a baby is turned to its side so as to lie against a surface.

Figure 5A:
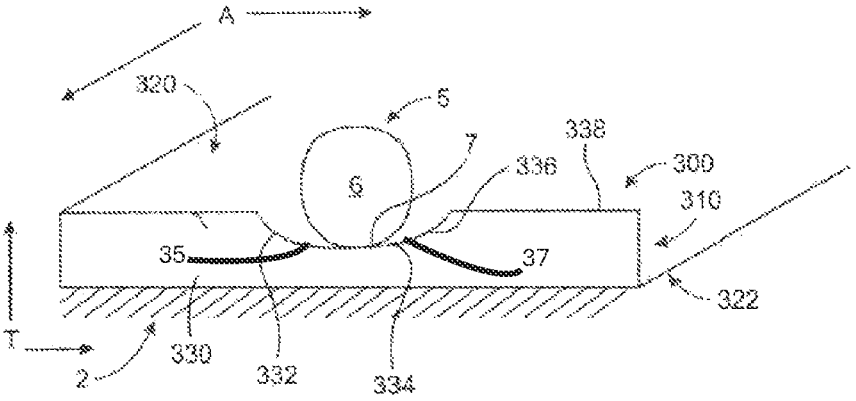
FIG. 5A depicts a sleeping device including an inclined surface positionable under a baby for sleep.
Figure 5B:
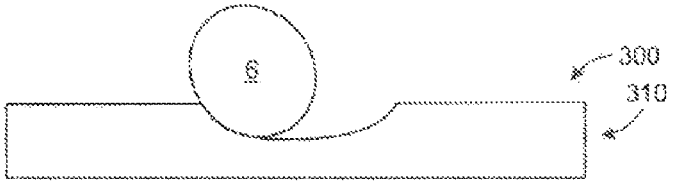
FIGS. 5B and 5C depict the sleeping device of FIG. 5A with head of baby turned to the left and right, respectively.
Figure 5C:
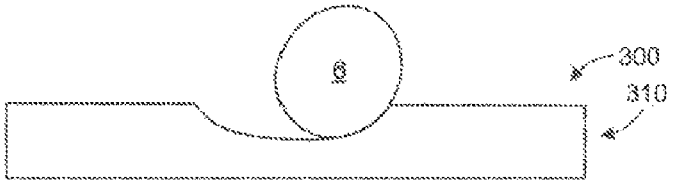

FIG. 5A depicts sleeping device 300 including an inclined mat 310 positionable under a baby 5 for sleep. FIGS. 5B and 5C depict the sleeping device of FIG. 5A with head of baby turned to the left and right, respectively. The inclined mat 300 includes a top surface area 320 (with "A" depicting the area), a bottom surface area 322 (with "A" depicting the area), and a thickness area T (with "T" depicting the area), the thickness area lying between the top surface area 320 and the bottom surface area 322. The bottom surface area 322 is configured to lie against a sleeping surface 2 and the top surface area 320 is configured to lie against the baby 5. The top surface area 320 of the inclined mat includes an elevated surface 330, a downwardly inclined surface 332 extending from the elevated surface, and a lower surface 334 extending from the downwardly inclined surface 332. The lower surface 334 is configured to receive a back 7 of the head 6 of the baby 5 when the baby is placed against the lower surface 34 of the inclined mat 310 when the mat is positioned under the baby. The downwardly inclined surface 332 is configured to support a side of the head of the baby lying against the downwardly inclined surface 332. The downwardly inclined surface 332 may be configured to prevent the head of the baby lying against the downwardly inclined surface 332 from turning in the direction of the downwardly inclined surface to a position wherein the side of the head of the baby lies planar with the sleeping surface 2.

The top surface area 320 of the inclined mat 310 further includes an upwardly inclined surface 336 extending from a side 37 of the lower surface 334 opposite the downwardly extending surface 332. The upwardly inclined surface 336 may be configured to support a side of the head of the baby lying against the upwardly inclined surface 336. The upwardly inclined surface may be configured to prevent the head of the baby lying against the upwardly inclined surface 336 from turning in the direction of the upwardly inclined surface 336 to a position wherein the side of the head lies planar with the sleeping surface.

The inclined mat may be configured with any dimensional that accomplishes the advantages of the inclined mat taught by this disclosure. The downwardly inclined surface 332 and upwardly inclined surface 336 may have the preferable or other degree of incline herein taught and may be mirror images of each other or have different geometries such as different areas, degrees of inclination, lengths, heights, and so on, all as taught by this disclosure. The inclined mat may be preferably formed from a foam but may be formed from other materials taught by this disclosure. The inclined mat may be provided with a removable covering.

Figure 6A:
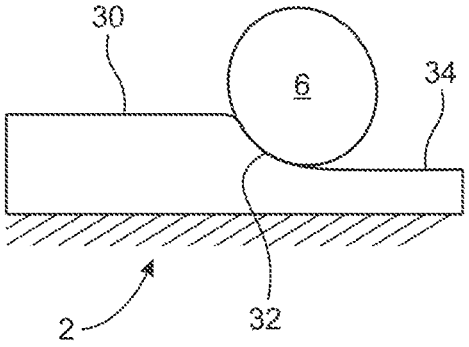
FIG. 6A reproduces a general reproduction of FIG. 1A.
Figure 6B:
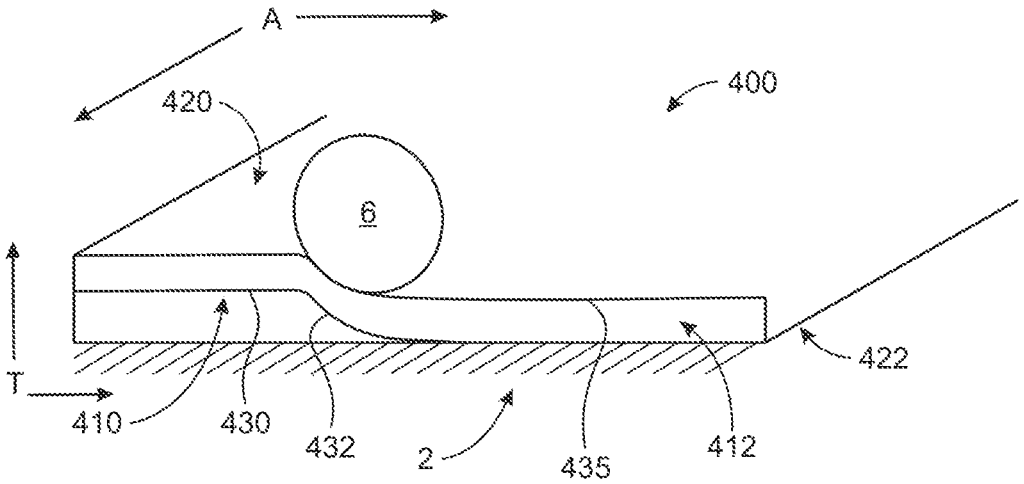
FIGS. 6B and 6C depict a sleeping device including a mat positionable under a baby for sleep and an inclinational segment for placing under the mat.
Figure 6C:
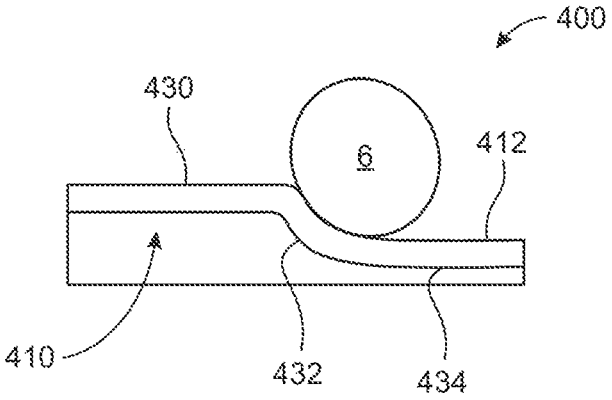

FIG. 6A is a general reproduction of FIG. 1A. FIGS. 6B and 6C depict a sleeping device 400 including a mat 412 positionable under a baby 5 for sleep and an inclinational segment 410 for placing under the mat 412. The inclinational segment 410 includes a top surface area 420 (with "A" depicting the area), a bottom surface area 422 (with "A" depicting the area), and a thickness area, the thickness area T (with "T" depicting the area) lying between the top surface area 420 and the bottom surface area 422. The bottom surface area 422 is configured to lie against a sleeping surface and the top surface area 420 is configured to lie against a baby.

In FIG. 6B, the top surface area 420 of the inclinational segment 410 includes an elevated surface 430 and a downwardly surface 432 extending from the elevated surface 430. The downwardly surface 432 may be inclined or perpendicular to the elevated surface. The downwardly surface 432 may be configured to incline the mat where the downwardly surface meets the mat to support a side of the head of the baby lying toward the downwardly surface. In this example, the mat may have sufficient stiffness to define a downwardly incline surface where the mat meets the downwardly surface of the elevational segment 410. In other embodiments, the downwardly surface 432 may be downwardly inclined, the downwardly inclined surface may be configured to support a side of the head of the baby lying toward the downwardly inclined surface. In this example, a mat that contours the profile of the elevational element may be used with the downwardly inclined surface providing the support to the side of the head.

The downwardly surface 432 may be configured to prevent the head of the baby lying toward the downwardly surface 432 from turning in the direction of the downwardly surface 432 to a position wherein the side of the head of the baby lies planar with the sleeping surface. In FIG. 6B, there is no lower surface extending from the downwardly surface as there is in the embodiment taught in FIG. 6C as explained below. In FIG. 6B, the lower surface against which the back of the head may rest may be the surface 435 of the mat as it lays upon the sleeping surface 2.

In FIG. 6C, the top surface area 420 of the inclinational segment 410 includes an elevated surface 430, a downwardly surface 432 extending from the elevated surface 430, and a lower surface 434 extending from the downwardly surface 432. The lower surface 434 may be configured to receive a back of the head of the baby when the baby is placed against the lower surface 434 of the mat when the mat is positioned under the baby. The downwardly surface 432 may be configured to incline the mat at the downwardly surface to support a side of the head of the baby lying toward the downwardly inclined surface in the alternate ways explained in FIG. 6B. The downwardly surface 432 may be configured to prevent the head of the baby from turning in the direction of the downwardly surface 432 to a position wherein the side of the head of the baby lies planar with the sleeping surface.

The inclination segment 410 positioned underneath the mat 412 provides the shape of the inclined surface to the mat which overlays the elevated segment 410.

The inclination segment may be configured with any dimensional that accomplishes the advantages that were previously explained in connection with the inclined mat as taught in previous embodiments by this disclosure. The downwardly surface 432 may have the preferable or other degree of incline herein taught in the previous embodiments. Alternatively it may be perpendicular to the elevated surface as previously explained. The inclination segment may be preferably formed from a foam but may be formed from other materials taught by this disclosure. The inclination segment may be provided with a removable covering.

As previously explained, the mat for use with an elevation segment may be preferably formed from a polyester material but may be formed from a cotton, polyester, nylon, linen, satin, or other material biofriendly to a baby. The physical qualities of the mat may be sufficient to perform the functions of this disclosure. For example, if the mat doubles as a play gym as disclosed below, the mat may have physical properties of both providing an overlay to the inclination surface and serving as a play gym when removed from the inclination surface. As another example, if the mat is to serve simply as the overlay to the inclination surface, the mat may provide for example some cushioning on top of the firm cushioning provide by the inclination segment.

In FIGS. 6A, 6B, the positioning of the inclination segment towards or away from the center of the area of the mat adjusts the location of the inclined surface with respect to the baby.

Figure 7A:
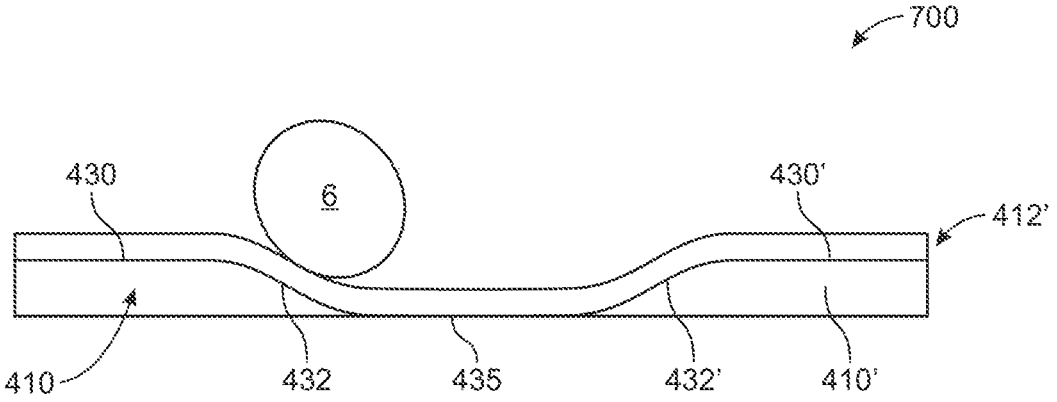
FIG. 7A depicts the inclination segment of FIG. 6B along with a second inclination segment positioned under mat.

FIG. 7A depicts the inclination segment 410 of FIG. 6B along with a second inclination segment 410' positioned under mat 412'. The second inclination segment 410' may include the features of inclination segment 410. Each of the inclination segment 410 and the inclination segment 410' may be configured with any dimension and geometry that accomplishes the advantages that were previously explained in connection with the inclined mat as taught in previous embodiments by this disclosure. Each of the inclination segment 410 and the inclination segment 410' may have the preferable or other degree of incline herein taught in the previous embodiments. Each of the inclination segment 410 and the inclination element 410' may be preferably formed from a foam but may be formed from other materials taught by this disclosure. The inclination segment may be provided with a removable covering.

Figure 7B:
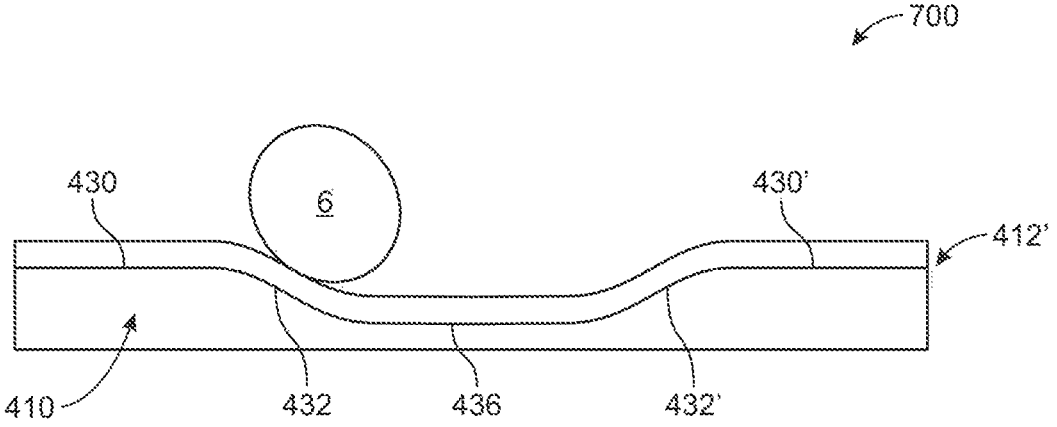
FIG. 7B depicts the inclination segment of FIG. 6C further including an upwardly surface extending from a side of a lower surface opposite the downwardly extending surface.

FIG. 7B depicts the inclination segment 410 of FIG. 6C further including an upwardly surface 432' extending from a side of the lower surface 436 opposite the downwardly extending surface 432. The upwardly extending surface 432' may be inclined or perpendicular to the elevated surface as previously taught. The upwardly surface 432' may be configured to incline the mat at the upwardly surface to support a side of the head of the baby lying toward the upwardly inclined surface 432'. The upwardly surface 432' may be configured to prevent the head of the baby from turning in the direction of the upwardly surface to a position wherein the side of the head lies planar with the sleeping surface.

In FIG. 7, the inclination segment 410 alone (FIG. 7B) or in combination with inclination segment 410' (FIG. 7A) positioned underneath the mat 412' provides the shape of the inclined surface to the mat 412' which overlays the inclination segment 410 alone (FIG. 7B) or in combination with inclination segment 410' (FIG. 7A).

Each of the inclination segment 410 and the inclination segment 410' may be configured with any dimension and geometry that accomplishes the advantages that were previously explained in connection with the inclined mat as taught in previous embodiments by this disclosure. Each of the inclination segment 410 and the inclination segment 410' may have the preferable or other degree of incline herein taught in the previous embodiments. Each may also have an incline that may be vertical to the elevated surface. Each of the inclination segment 410 and the inclination segment 410' may be preferably formed from a foam but may be formed from other materials taught by this disclosure. The inclination segment may be provided with a removable covering.

In FIGS. 7A, 7B, the positioning of the inclination segment 410 and the inclination segment 410' towards or away from the center of the area of the mat adjusts the location of the inclined surface with respect to the baby.

The sleeping device of any of the embodiments above described may be used in combination with a crib forming a baby sleeping system, the sleeping device positioned inside the crib in the baby sleeping system.

The sleeping device of any of the embodiments above described may be used with a basinet forming a baby sleeping system, the sleeping device positioned inside the crib in the baby sleeping system.

Figure 8A:
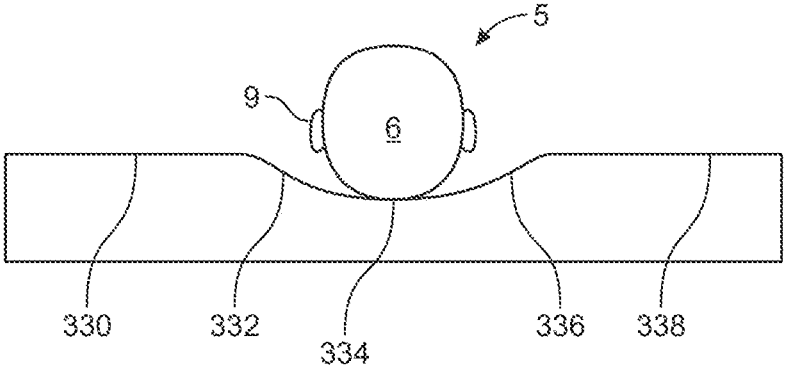
FIG. 8A depicts a baby in an inclined position on the sleeping device depicted and explained in FIG. 5.
Figure 8B:
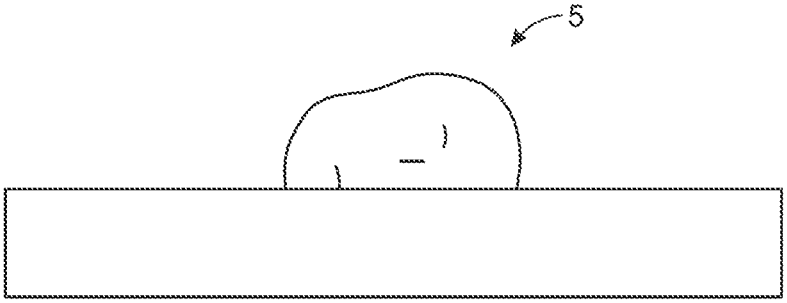
FIG. 8B is a view taken of the front face of the baby in an inclined position on the sleeping device.

FIG. 8A depicts a baby in an inclined position on the sleeping device depicted and explained in FIG. 5. FIG. 8A is a view taken of the top of the head 6 of the baby in an inclined position on the sleeping device. FIG. 8B is a view taken of the front face of the baby in an inclined position on the sleeping device. In one example, FIG. 8A depicts the elevated surface 338 may be spatially at about the level of the position of the ear 9 of the baby when the back of the baby is positioned against the lower surface 334. In this position, the inclined surface 336 may stop the roll of the head of the baby toward the elevated surface with the nose of the baby coming to rest above the elevated surface. The inclined surface of the sleeping device may be of any height that is safe to the baby.

The sleeping device of any of the embodiments above described may be configured to be rectangular. For example, the inclined mat or the inclination segment may have a top surface that is rectangular. The sleeping device of any of the embodiments above described may be configured to be circular. For example, the inclined mat or the inclination segment may have a top surface that is circular.

Figure 9A:
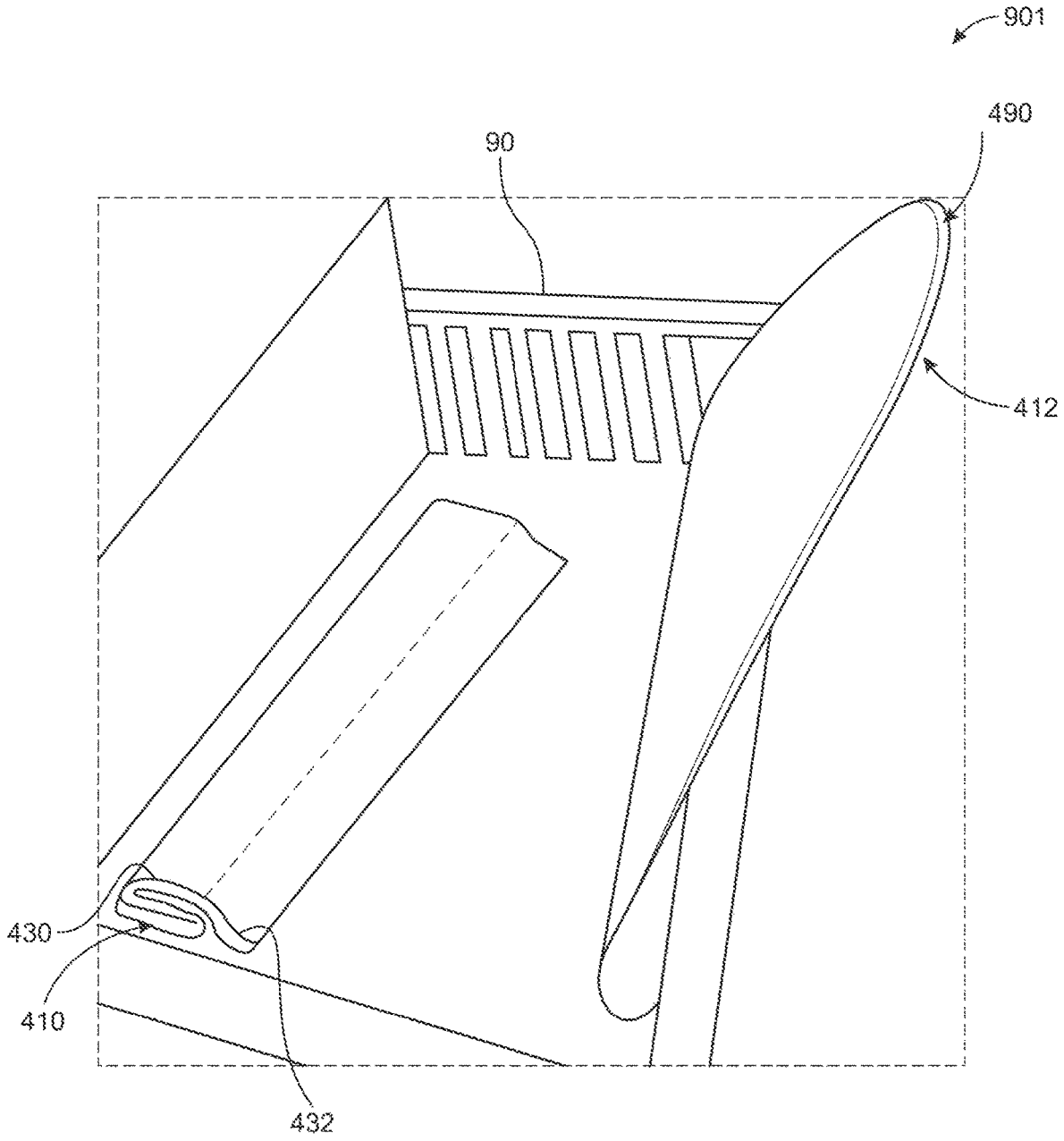
FIGS. 9A, 9B, 9C depict the embodiment of FIG. 6B using a mat that doubles as a play gym.
Figure 9B:
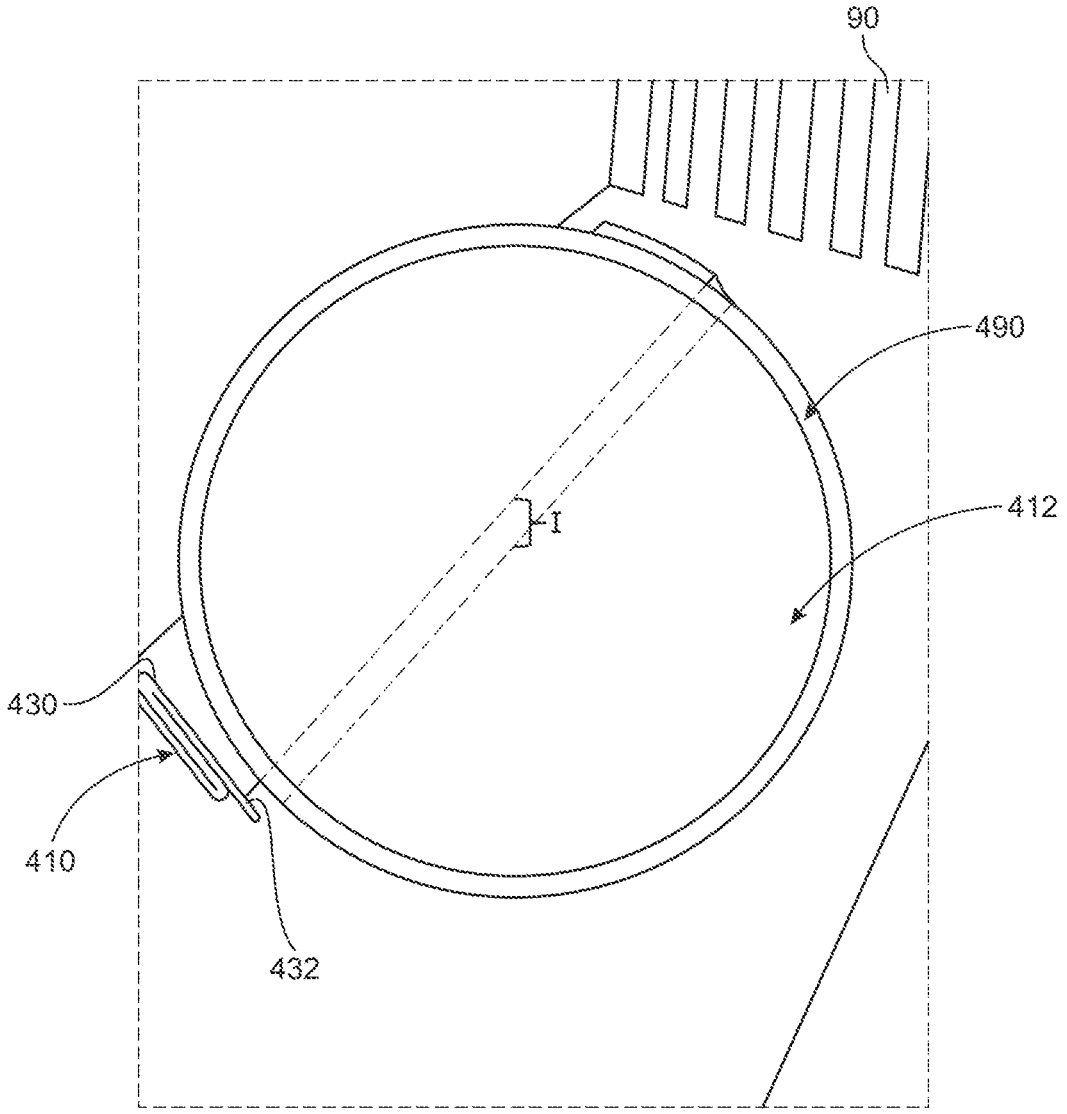
Figure 9C:
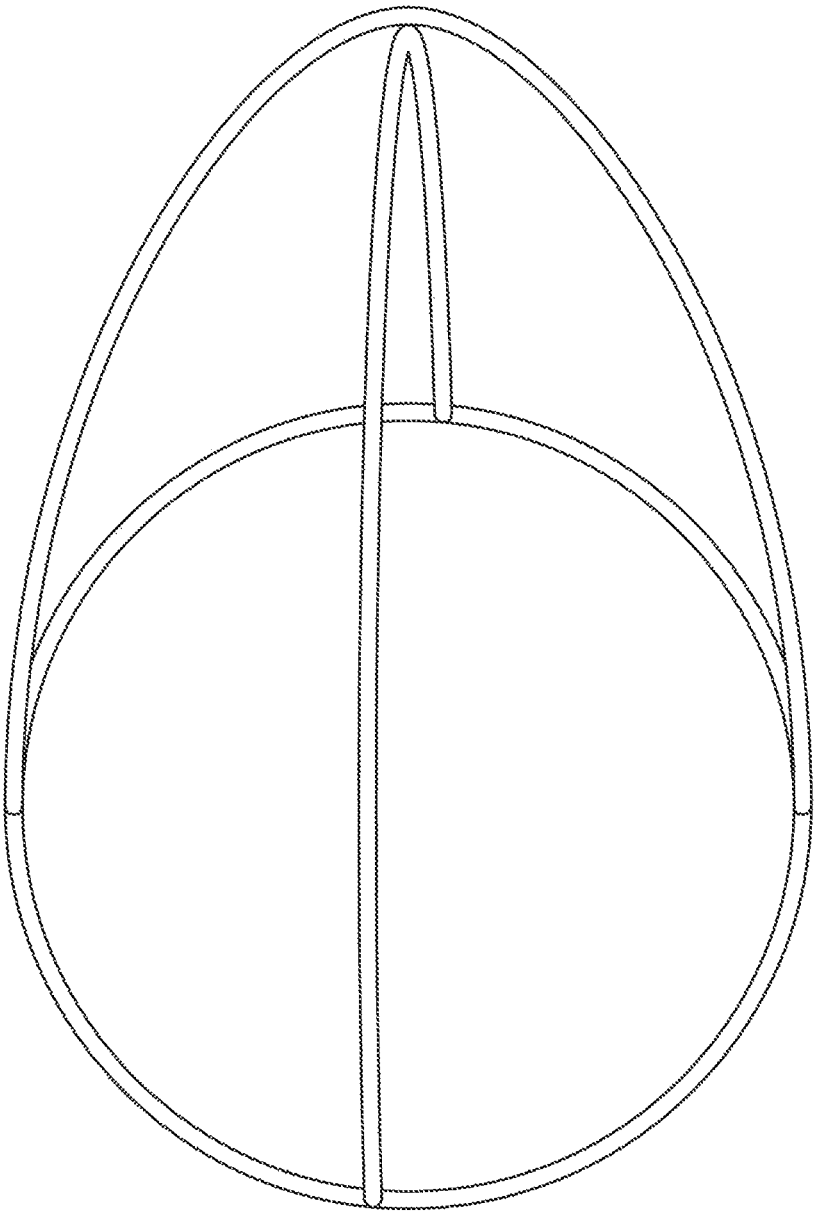

The sleeping device of any of the embodiments above described may be configured to have any shape. For example, the inclined mat or the inclination segment may have a top surface is configured into a shape of choice for the application FIGS. 9A, 9B, 9C depict the embodiment of FIG. 6B using a mat 412 that doubles as a play gym. As depicted in FIG. 9A, the sleeping device 901 comprises the mat 412 and an inclination segment 410. The inclination segment 410 has an elevation surface 430 and a downwardly segment 432. In this example, the inclination segment is formed from a towel wrapped as shown with the downwardly segment 432 tending to be more vertical with respect to the elevation surface 430 of the inclination segment 410. Mat 412 is a gym mat made by Infantino. In that example, the material is a soft fine construct that is stretched and kept from gathering by a support member 490 through which the ends of the material is placed and held. In FIG. 9A, the mat 412 is depicted against the front of crib 90. In FIG. 9B, the mat 412 is depicted overlaying the inclination segment 410. As shown, downwardly surface 432 inclines "I" the mat at the downwardly surface 432 to support a side of the head of the baby lying toward the downwardly surface 432. The downwardly surface may be configured to prevent the head of the baby from turning in the direction of the downwardly surface to a position wherein the side of the head of the baby lies planar with the sleeping surface. FIG. 9C shows the mat 412 removed from the crib and used as a play gym.

There is thus disclosed a sleeping device including an inclined mat positionable under a baby for sleep. The inclined mat includes a top surface area, a bottom surface area, and a thickness area, the thickness area lying between the top surface area and the bottom surface area. The bottom surface area may be configured to lie against a sleeping surface and the top surface area is configured to lie against a baby. The top surface area of the inclined mat includes an elevated surface, a downwardly inclined surface extending from the elevated surface, and a lower surface extending from the downwardly inclined surface. The lower surface may be configured to receive a back of the head of the baby when the baby is placed against the lower surface of the inclined mat when the inclined mat is positioned under the baby. The downwardly inclined surface may be configured to support a side of the head of the baby lying against the downwardly inclined surface. The downwardly inclined surface may be configured to prevent the head of the baby lying against the downwardly inclined surface from turning in the direction of the downwardly inclined surface to a position wherein the side of the head of the baby lies planar with the sleeping surface.

In another aspect, the top surface area of the inclined mat may further include an upwardly inclined surface extending from a side of the lower surface opposite the downwardly extending surface. The upwardly inclined surface may be configured to support a side of the head of the baby lying against the upwardly inclined surface. The upwardly inclined surface may be configured to prevent the head of the baby lying against the upwardly inclined surface from turning in the direction of the upwardly inclined surface to a position wherein the side of the head lies planar with the sleeping surface;

In another aspect, the sleeping device may be configured for combination with a crib, the combination sleeping device and crib forming a baby sleeping system, the sleeping device positioned inside the crib in the baby sleeping system.

In another aspect, the sleeping device may be configured for combination with a bassinet, the combination sleeping device and bassinet forming a baby sleeping system, the sleeping device positioned inside the bassinet in the baby sleeping system.

In another aspect, the elevated surface may be spatially positioned at about the level of the position of the ear of the baby when the back of the baby is positioned against the lower surface.

In another aspect, the top surface area of the inclined mat may be rectangular.

In another aspect, the top surface area of the inclined mat may be circular.

In another aspect, the inclined mat may be configured to double as a playing pad.

In another aspect, the device is configured for use by a person not a baby.

In another aspect, a sleeping device includes a mat positionable under a baby for sleep and an inclination segment for placing under the mat. The inclination segment includes a top surface area, a bottom surface area, and a thickness area, the thickness area lying between the top surface area and the bottom surface area. The bottom surface area is configured to lie against a sleeping surface and the top surface area is configured to lie against a baby. The top surface area of the inclination segment includes an elevated surface and a downwardly surface extending from the elevated surface. The downwardly surface may be at a positive incline (i.e., less than 90 degrees with respect to the elevated surface), vertical to the elevated surface, or at a negative incline to the elevated surface (i.e., greater than 90 degrees with respect to the elevated surface). The downwardly surface may be configured to incline the mat at the downwardly surface to support a side of the head of the baby lying toward the downwardly surface. The downwardly surface may be configured to prevent the head of the baby from turning in the direction of the downwardly surface to a position wherein the side of the head of the baby lies planar with the sleeping surface.

In another aspect, with the sleeping device with inclination segment, the inclination segment further includes a lower surface extending from the downwardly surface. The lower surface may be configured to receive a back of the head of the baby when the baby is placed against the lower surface of the mat when the mat is positioned under the baby;

In another aspect, with the sleeping device with inclination segment, the top surface area of the segment further includes an upwardly surface extending from a side of the lower surface opposite the downwardly extending surface. The upwardly surface may be at a positive incline (i.e., less than 90 degrees with respect to the elevated surface), vertical to the elevated surface, or at a negative incline to the elevated surface (i.e., greater than 90 degrees with respect to the elevated surface). The upwardly surface may be configured to incline the mat at the downwardly surface to support a side of the head of the baby lying against the inclined mat. The upwardly surface may be configured to prevent the head of the baby from turning in the direction of the upwardly surface to a position wherein the side of the head lies planar with the sleeping surface.

In another aspect, with the sleeping device with segment, the inclination segment provides a first inclination segment and the device further includes a second inclination segment for placing under the mat. The second inclination segment including a top surface area, a bottom surface area, and a thickness area, the thickness area lying between the top surface area and the bottom surface area. The bottom surface area may be configured to lie against a sleeping surface and the top surface area is configured to lie against a baby. The top surface area of the second inclination segment includes an elevated surface and a downwardly surface extending from the elevated surface. The downwardly surface may be configured to incline the mat at the downwardly surface to support a side of the head of the baby. The downwardly surface may be configured to prevent the head of the baby from turning in the direction of the downwardly surface to a position wherein the side of the head of the baby lies planar with the sleeping surface. The downwardly surface of the first inclination segment and the downwardly surface of the first inclination segment are positioned on opposing sides of the head of a baby to prevent the head of the baby from turning in either the direction of the downwardly surface of the first inclination segment or the direction of the downwardly surface of the second inclination segment to a position wherein the side of the head lies planar with the sleeping surface.

In another aspect, the sleeping device with segment may be configured for combination with a crib, the combination sleeping device and crib forming a baby sleeping system, the sleeping device positioned inside the crib in the baby sleeping system.

In another aspect, the sleeping device with segment may be configured for combination with a bassinet, the combination sleeping device and bassinet forming a baby sleeping system, the sleeping device positioned inside the bassinet in the baby sleeping system.

In another aspect, with the sleeping device with segment, the elevated surface is spatially positioned at about the level of the position of the ear of the baby when the back of the baby is positioned against the lower surface.

In another aspect, with the sleeping device with segment, the top surface area of the mat may be rectangular.

In another aspect, with the sleeping device with segment, the top surface area of the mat may be circular.

In another aspect, with the sleeping device with segments the mat may double as a playing pad.

In another aspect, with the sleeping device with segment, the sleeping device may be configured for use by a person not a baby.

This disclosure finds application also in head support products for any person whose side of the head when the person is lying against a surface in an inclined position must be kept from lying planar with the surface. This disclosure device may be useable as an inclined head resting product for any person whose side of the head when the person is lying against a surface in an inclined position must be kept from lying planar with the surface.

While this disclosure has been described in connection with specific embodiments, it is evident that numerous alternatives, modifications, and variations will be apparent to those skilled in the art within the spirit and scope of the above disclosure.

What is claimed is:

1. A stationary sleeping device comprising an inclined mat positionable under a baby for sleep, the inclined mat comprising:

a top surface area, a bottom surface area, and a thickness area, the thickness area lying between the top surface area and the bottom surface area;

the bottom surface area is configured to lie against a sleeping surface and the top surface area is configured to lie against a baby;

the top surface area of the inclined mat includes an elevated top surface area, a nonlinear downwardly inclined top surface area, and a flat lower top surface area, the downwardly inclined top surface area extending from and having a common transition line with the elevated top surface area, the downwardly inclined top surface area extending to and having a common transition line with the lower top surface area such that there is no break in physical continuity between the lower top surface area and the downwardly inclined top surface area, the downwardly inclined top surface area transitioning to the lower top surface area as one continuous top surface;

the lower top surface area terminating in an edge, the terminating edge running from the lower top surface area to the bottom surface, the terminating edge lying opposite the common transition line the lower top surface area shares with the inclined top surface area;

the terminating edge having an elevation taken from the bottom surface area up that is at all points at or below the elevation of the lower top surface area taken from the bottom surface area up;

the lower top surface area receives a back of the head of a baby when the baby is placed against the lower top surface area of the inclined mat when the inclined mat is positioned under a baby;

the downwardly inclined top surface area supports a side of the head of a baby lying against the downwardly inclined top surface area;

the downwardly inclined top surface area prevents the head of a baby lying against the downwardly inclined top surface area from turning in the direction of the downwardly inclined top surface area;

wherein the elevated top surface area is supported in an elevated position with respect to the lower top surface area by the thickness area lying between the top surface area and the bottom surface area of the inclined mat; and wherein the inclined mat is formed as a one-piece structure.

2. The sleeping device of claim 1, wherein the inclined mat positionable under a baby for sleep is configured to fit inside a crib.

3. The sleeping device of claim 1, wherein the inclined mat positionable under a baby for sleep is configured to fit inside a bassinet.

4. The sleeping device of claim 1, wherein the inclined top surface area is a flat surface.

5. The sleeping device of claim 1, wherein the inclined top surface area is a surface with a curve.

6. The sleeping device of claim 1, wherein the downwardly inclined top surface area includes a degree of incline when taken with respect to the support surface of approximately 30 degrees.

7. The sleeping device of claim 1, wherein the downwardly inclined top surface area includes a degree of incline when taken with respect to the support surface of less than 30 degrees.

8. The sleeping device of claim 1, wherein the inclined top surface area includes a degree of incline when taken with respect to the support surface of below approximately 15 degrees.

9. The sleeping device of claim 1, wherein the inclined mat positionable under a baby for sleep further comprises a removable covering.

10. The sleeping device of claim 1, wherein the inclined mat comprises a material configured so as to not gather so as to avoid ruffles or bunches that may interfere with the breathing of a baby.

11. The sleeping device of claim 1 wherein the elevated top surface area is spatially positioned at about the level of the position of the ear of a baby when the back of a baby is positioned against the lower surface.

12. The sleeping device of claim 1 wherein the top surface area of the inclined mat is rectangular.

13. The sleeping device of claim 1 wherein the top surface area of the inclined mat is circular.

14. The sleeping device of claim 7, wherein the downwardly inclined top surface area includes a degree of incline when taken with respect to the support surface of greater than 15 degrees.

15. A stationary sleeping device comprising an inclined mat positionable under a person for sleep, the inclined mat comprising:

a top surface area, a bottom surface area, and a thickness area, the thickness area lying between the top surface area and the bottom surface area;

the bottom surface area is configured to lie against a sleeping surface and the top surface area is configured to lie against a person;

the top surface area of the inclined mat includes an elevated top surface area, a nonlinear downwardly inclined top surface area, and a flat lower top surface area, the downwardly inclined top surface area extending from and having a common transition line with the elevated top surface area, the downwardly inclined top surface area extending to and having a common transition line with the lower top surface area such that there is no break in physical continuity between the lower top surface area and the downwardly inclined top surface area, the downwardly inclined top surface area transitioning to the lower top surface area as one continuous top surface;

wherein the inclined mat has a length that is longer than the width of the inclined mat;

wherein the common transition line with the lower top surface area runs the length of the inclined mat;

wherein the lower top surface area terminating in an edge, the terminating edge running from the lower top surface area to the bottom surface, the terminating edge lying opposite the common transition line the lower top surface area shares with the inclined top surface area;

wherein the terminating edge having an elevation taken from the bottom surface area up that is at all points at or below the elevation of the lower top surface area taken from the bottom surface area up;

wherein the lower top surface area receives a back of the head of a person when a person is placed against the lower top surface area of the inclined mat when the inclined mat is positioned under a person;

wherein the downwardly inclined top surface area supports a side of the head of a person lying against the downwardly inclined top surface area; and wherein the downwardly inclined top surface area prevents the head of a person lying against the downwardly inclined top surface area from turning in the direction of the downwardly inclined top surface area;

wherein the elevated top surface area is supported in an elevated position with respect to the lower top surface area by the thickness area lying between the top surface area and the bottom surface area of the inclined mat; and wherein the inclined mat is formed as a one-piece structure.

16. The sleeping of claim 15, wherein the inclined mat positionable under a baby for sleep further comprises a removable covering.

17. The sleeping device of claim 15, wherein the inclined top surface area includes a degree of incline when taken with respect to the support surface of below approximately 15 degrees.

18. A stationary sleeping device comprising an inclined mat positionable under a baby for sleep in combination with an overlay mat:

wherein the inclined mat comprising:

a top surface area, a bottom surface area, and a thickness area, the thickness area lying between the top surface area and the bottom surface area;

the bottom surface area is configured to lie against a sleeping surface and the top surface area is configured to hold the overlay mat against a baby;

wherein the top surface area of the inclined mat includes an elevated top surface area, a nonlinear downwardly inclined top surface area, and a flat lower top surface area, the downwardly inclined top surface area extending from and having a common transition line with the elevated top surface area, the downwardly inclined top surface area extending to and having a common transition line with the lower top surface area such that there is no break in physical continuity between the lower top surface area and the downwardly inclined top surface area, the lower top surface area and the downwardly inclined top surface area forming one continuous surface;

wherein the inclined mat has a length that is longer than the width of the inclined mat;

wherein the common transition line with the lower top surface area runs the length of the inclined mat;

wherein the lower top surface area terminating in an edge, the terminating edge running from the lower top surface area to the bottom surface, the terminating edge lying opposite the common transition line the lower top surface area shares with the inclined top surface area;

wherein the terminating edge having an elevation taken from the bottom surface area up that is at all points at or below the elevation of the lower top surface area taken from the bottom surface area up;

wherein the downwardly inclined top surface area of the inclined mat causes the overlay mat to support a side of the head of a baby lying against the downwardly inclined top surface area of the inclined mat;

wherein the downwardly inclined top surface area of the inclined mat prevents the head of a baby lying against the overly mat lying against the downwardly inclined top surface area from turning in the direction of the downwardly inclined top surface area of the inclined mat; and wherein the overlay mat lies over the downwardly inclined top surface area of the inclined mat;

wherein the shape of the downwardly inclined top surface area of the inclined mat configures the shape of the overlay mat;

wherein the downwardly inclined top surface area of the inclined mat prevents the head of a baby from turning in the direction of the downwardly inclined top surface area;

wherein the elevated top surface area of the inclined mat is supported in an elevated position with respect to the lower top surface area of the inclined mat by the thickness area lying between the top surface area and the bottom surface area of the inclined mat;

wherein the downwardly inclined top surface area is either a flat surface or a surface with a concave curve; and wherein the inclined mat is formed as a one-piece structure.

19. The sleeping device of claim 18, wherein the overlay mat comprises a soft material that is stretched and kept from gathering by a support member through which the ends of the material is secured and held.

20. The sleeping device of claim 18, wherein the overlay mat doubles as a playing pad.

21. The sleeping of claim 18, wherein the inclined mat positionable under a baby for sleep further comprises a removable covering.

22. The sleeping device of claim 18, wherein the inclined top surface area includes a degree of incline when taken with respect to the support surface of below approximately 15 degrees.

* * * * *